US008342062B2

(12) United States Patent
Chen et al.

(10) Patent No.: US 8,342,062 B2
(45) Date of Patent: Jan. 1, 2013

(54) MULTI-ANGLE HAND TOOL

(75) Inventors: Tsai-Ching Chen, Chang Hua Hsien (TW); Fanny Hi, Yilan (TW)

(73) Assignee: Tsai-Ching Chen, Chang Hua Hsien (TW)

( * ) Notice: Subject to any disclaimer, the term of this patent is extended or adjusted under 35 U.S.C. 154(b) by 258 days.

(21) Appl. No.: 12/884,266

(22) Filed: Sep. 17, 2010

(65) Prior Publication Data

US 2011/0146459 A1 Jun. 23, 2011

(30) Foreign Application Priority Data

Dec. 17, 2009 (TW) ..... 98143382 A

(51) Int. Cl.
*B25B 23/16* (2006.01)

(52) U.S. Cl. ..... 81/177.9; 81/177.7

(58) Field of Classification Search ..... 81/177.8, 81/177.5–177.7, 177.9; 7/165, 168
See application file for complete search history.

(56) References Cited

U.S. PATENT DOCUMENTS

| | | | | |
|---|---|---|---|---|
| 5,806,119 | A * | 9/1998 | Wood | 7/118 |
| 6,564,680 | B1 | 5/2003 | Rinner et al. | 81/177.5 |
| 7,000,507 | B1 | 2/2006 | Lin | 81/177.9 |
| 7,047,846 | B1 * | 5/2006 | Hu | 81/177.7 |
| 7,174,810 | B1 * | 2/2007 | Lin | 81/63.1 |
| 7,197,965 | B1 | 4/2007 | Anderson | 81/73 |
| 7,287,450 | B1 * | 10/2007 | Liao | 81/177.9 |
| 7,698,972 | B2 | 4/2010 | Hi | 81/177.8 |
| 2009/0223329 | A1 * | 9/2009 | Hi | 81/177.8 |

OTHER PUBLICATIONS

Taiwanese Patent Publication No. TW 200934619, Aug. 16, 2009, 2 pages.
Taiwanese Patent No. TW 421108, Feb. 1, 2001, 5 pages.
Taiwanese Patent No. TW 454650, Sep. 11, 2001, 5 pages.
Taiwanese Patent No. TW 533970, May. 21, 2003, 5 pages.
Taiwanese Patent No. TW 571877, Jan. 11, 2004, 8 pages.
Taiwanese Utility No. TW M297641, Nov. 1, 2005, 9 pages.
Taiwanese Utility No. TW M322862, Dec. 1, 2007, 6 pages.
Taiwanese Patent No. TW 1253972, May. 1, 2006, 9 pages.
Chinese Patent Publication No. CN 1899770A, Jan. 24, 2007, 14 pages.
UK Patent Publication No. GB 2464349A, Apr. 21, 2010, 26 pages.
German Patent Publication No. DE 102009005487A1, Jul. 22, 2010, 21 pages.

* cited by examiner

*Primary Examiner* — David B Thomas

(57) ABSTRACT

A multi-angle hand tool for a handle includes a shank including a body, and a compartment defined in the body. An operating device includes a connecting end having an engaging portion defined thereon. A guide is mounted in the compartment and includes an embedding portion defined thereon. A connecting device is disposed and interconnected between the operating device and the guide. The multi-angle hand tool has a plurality of operation modes, and, in each operation mode, the operating device is prevented from moving and pivoting with respect to the shank by engaging the engaging portion with the embedding portion. Furthermore, a longitudinal length of the operating device is perpendicular to, angled non-perpendicularly to, or aligned with the longitudinal length of the body of the shank selectively for different operation modes.

15 Claims, 13 Drawing Sheets

MULTI-ANGLE HAND TOOL

BACKGROUND OF THE INVENTION

1. Field of the Invention

The present invention relates to a multi-angle tool handle.

2. Description of the Related Art

U.S. Pat. No. 7,698,972 discloses a multi-angle hand tool including a handle device, an interconnecting element pivotally disposed in the handle device, a locking device installed in the handle device and operable between a first position such that the interconnecting element can be pivoted and a second position such that the interconnecting element can not be pivoted, and a connecting device pivotally coupled to an end of the interconnecting element. The multi-angle tool can have three operation modes only. In a first operation mode, the connecting device is aligned with the handle device, and they are in a form of a letter "I". In a second operation mode, the connecting device is perpendicular with the handle device, and they are in a form of a letter "L". In a third operation mode, the connecting device is perpendicular to the handle device, and they are in a form of a letter "T".

It is still desirable to improve the multi-angle hand tool so that it has more than three operation modes and has a simple structure.

The present invention is, therefore, intended to obviate or at least alleviate the problems encountered in the prior art.

SUMMARY OF THE INVENTION

According to the present invention, a multi-angle hand tool includes a shank including a body, a compartment defined in an outer peripheral edge of the body. The body and the compartment have longitudinal lengths extending in the same direction. Further, an operating device includes a connecting end having an engaging portion defined thereon. Further, a guide is mounted in the compartment and includes an embedding portion defined thereon. Further, a connecting device is disposed and interconnected between the operating device and the guide to connect the operating device to the guide. Additionally, the operating device is movable and pivotal with respect to the guide in the shank.

The multi-angle hand tool has a plurality of operation modes, and, in each operation mode, the operating device is prevented from moving and pivoting with respect to the shank by engaging the engaging portion with the embedding portion. Furthermore, a longitudinal length of the operating device is perpendicular to, angled non-perpendicularly to, or aligned with the longitudinal length of the body of the shank selectively for different operation modes.

It is an object of the invention to provide a multi-angle hand tool that has a plurality of operation modes, particularly more than three.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
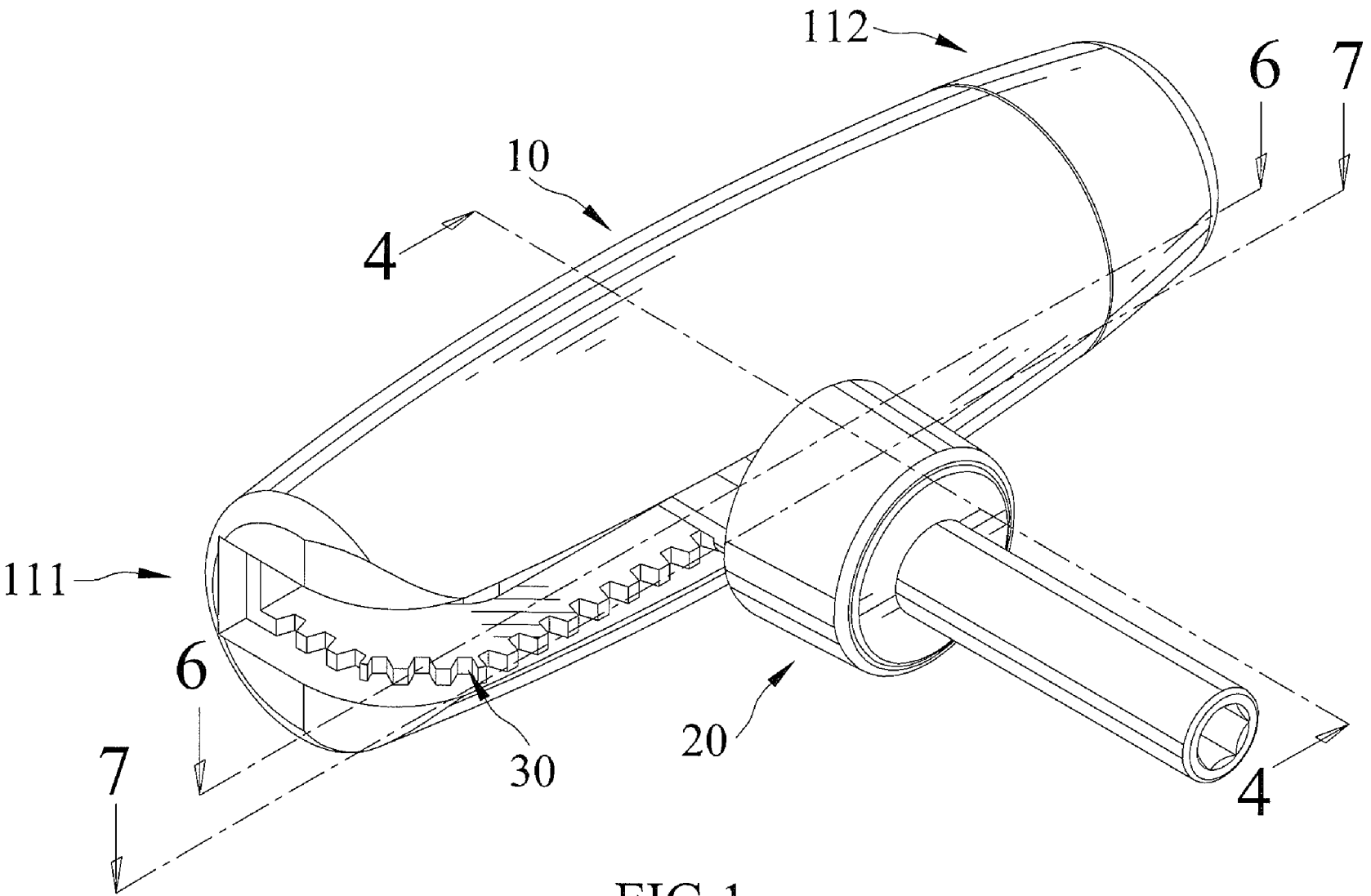
FIG. 1 is a perspective view of a multi-angle hand tool in accordance with the present invention.
Figure 2:
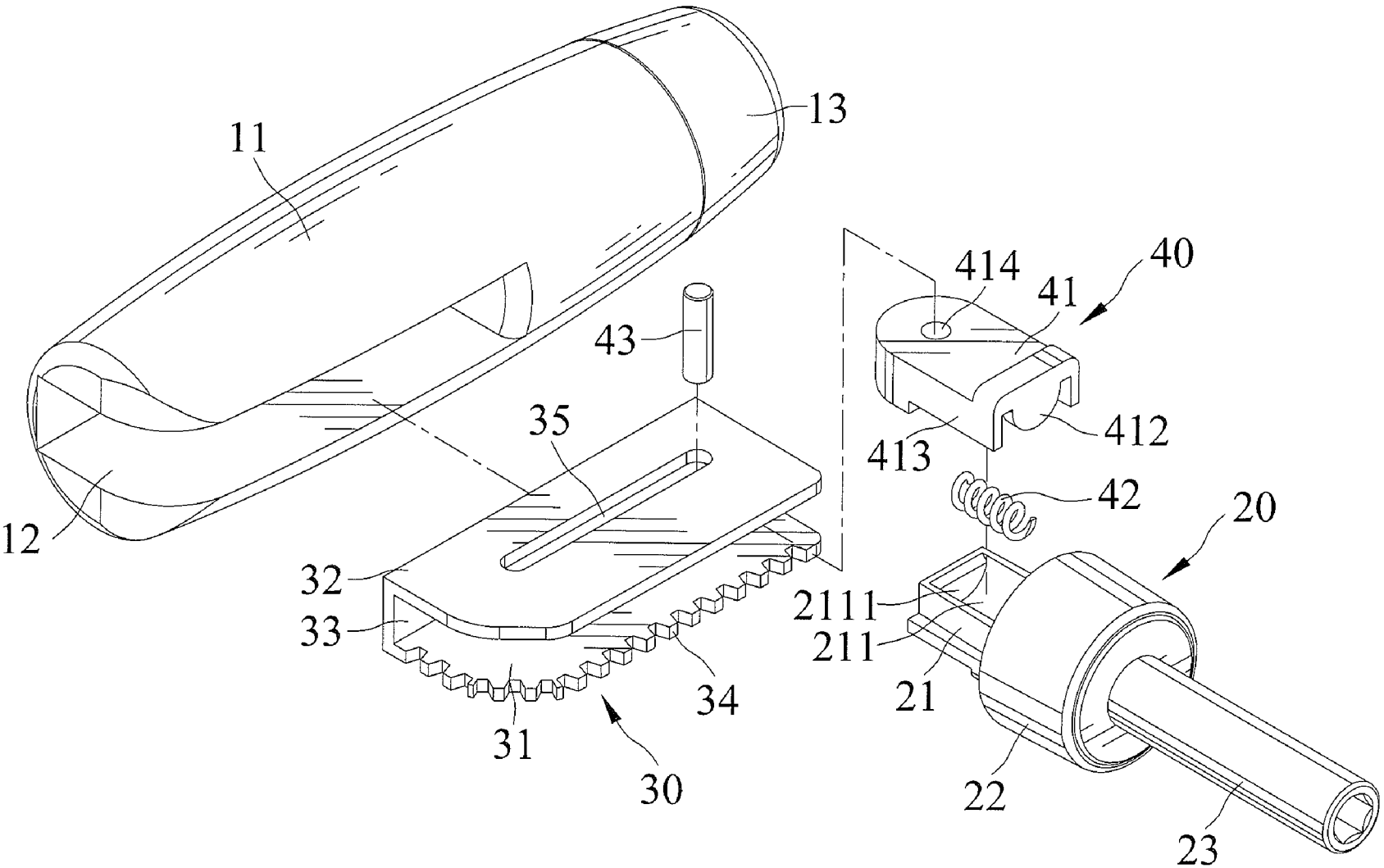
FIG. 2 is an exploded perspective view of the multi-angle hand tool shown in FIG. 1.
Figure 3:
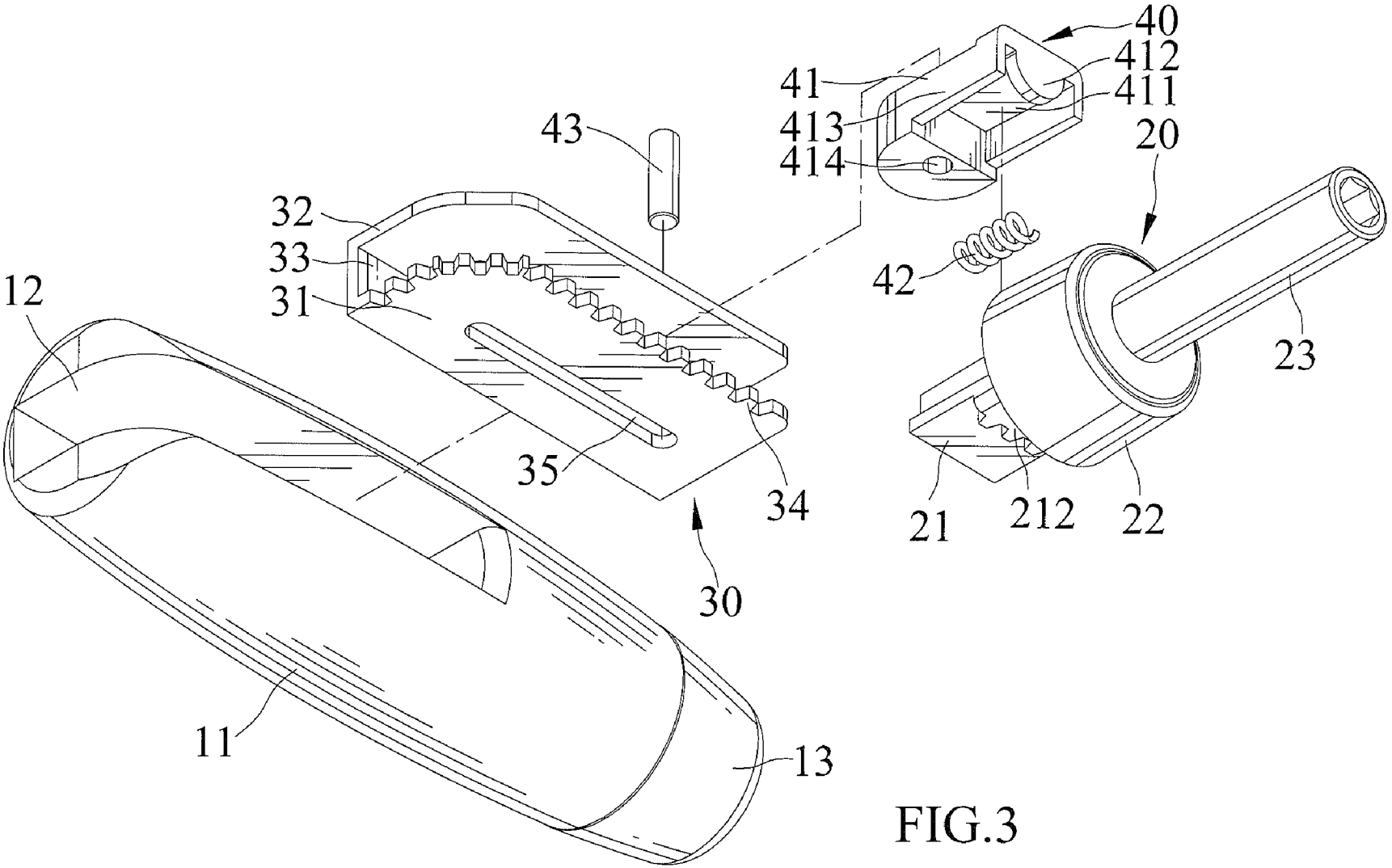
FIG. 3 is another exploded perspective view of the multi-angle hand tool shown in FIG. 1.
Figure 4:
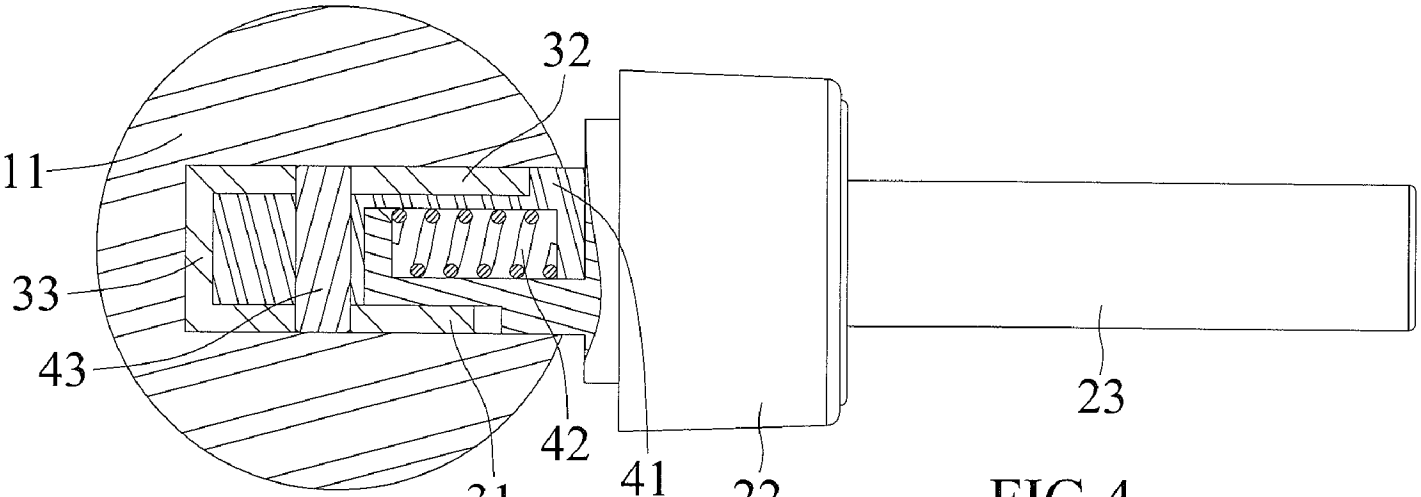
FIG. 4 is a cross-sectional view taken along line 4-4 of FIG. 1 and shows an operating device of the multi-angle hand tool in a locked mode.
Figure 5:
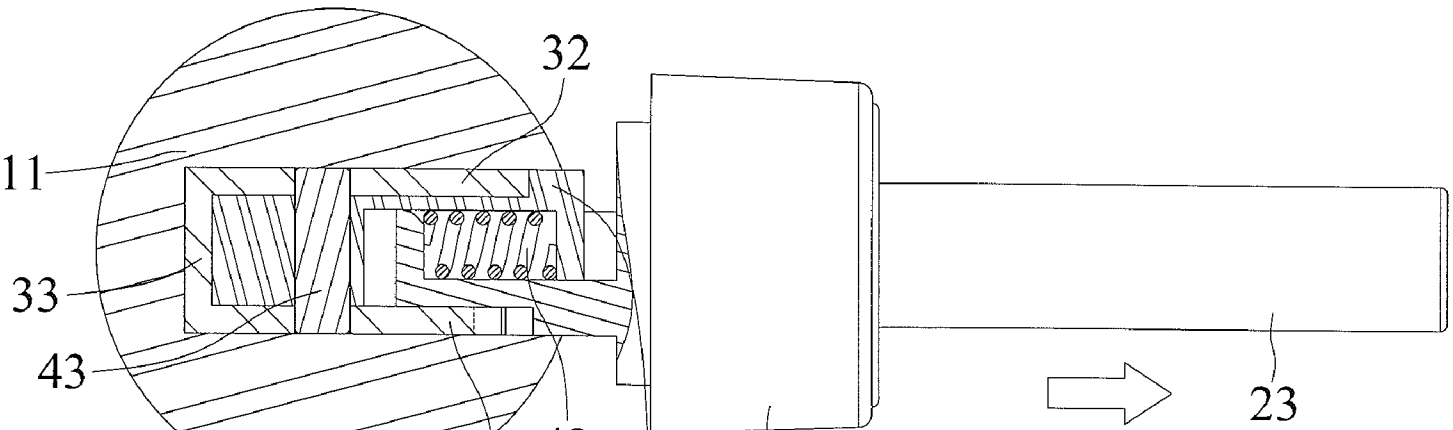
FIG. 5 is an extended cross-sectional view of FIG. 4 and shows the operating device in a released mode.
Figure 6:
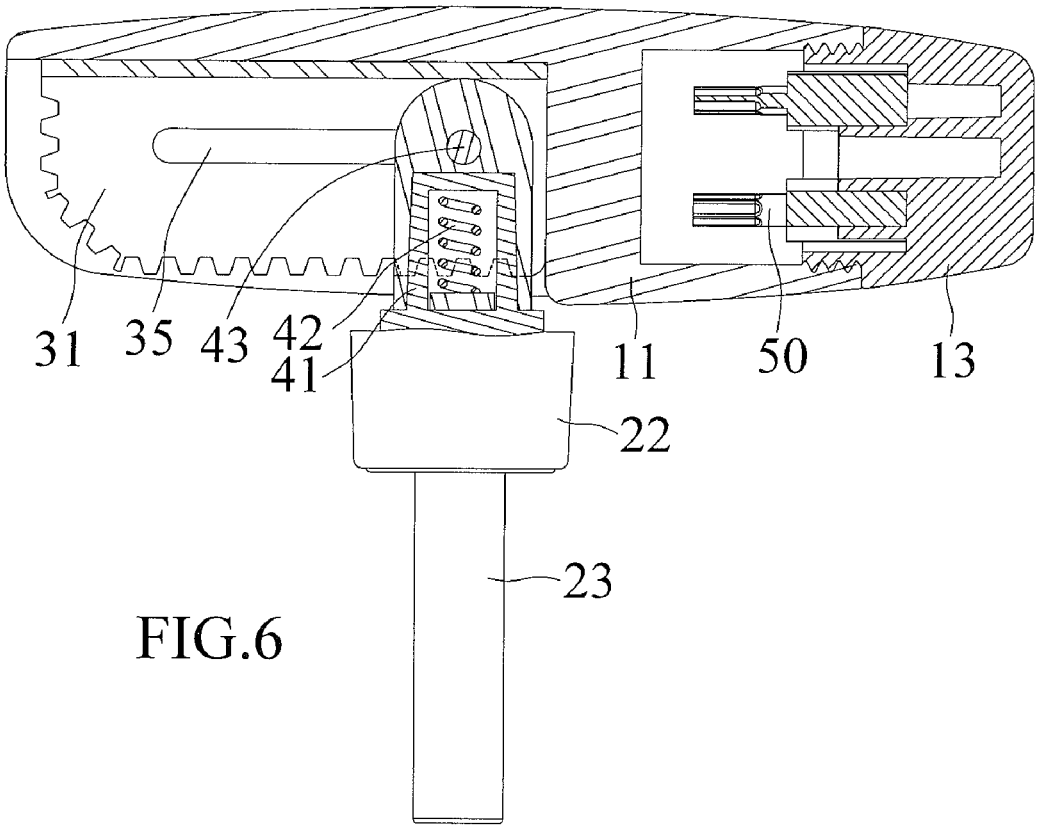
FIG. 6 is a cross-sectional view taken along line 6-6 of FIG. 1 and shows the operating device in the locked mode.
Figure 7:
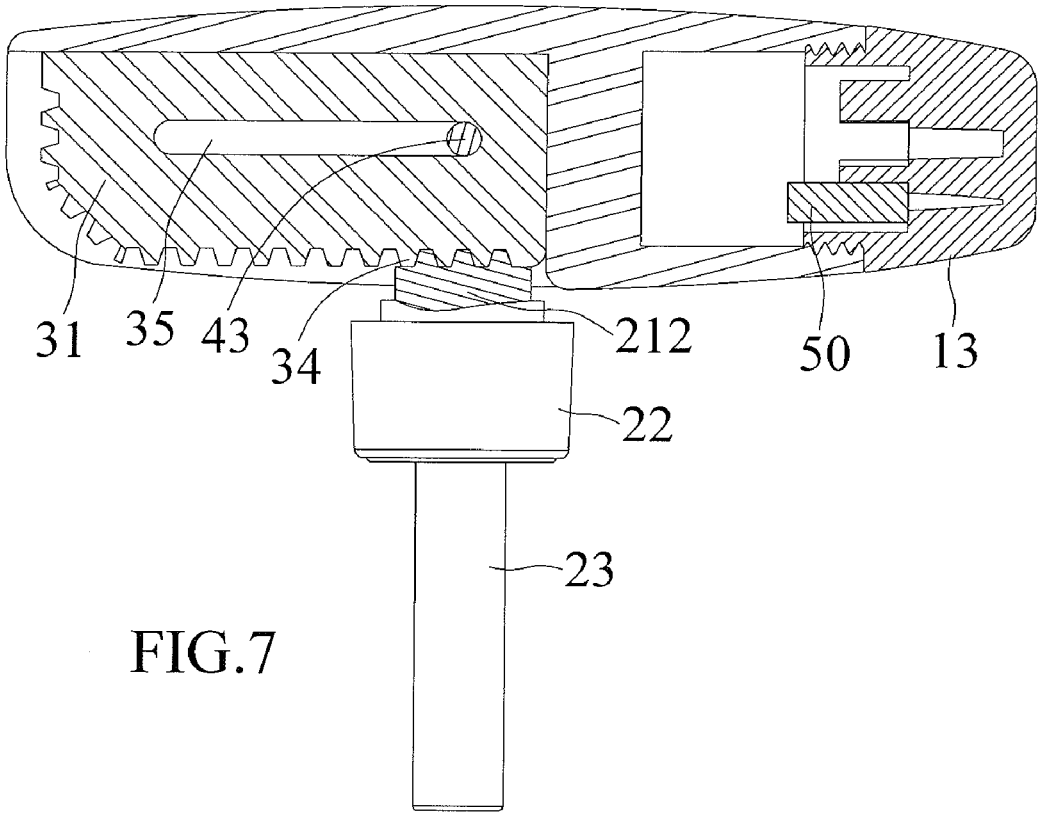
FIG. 7 is a cross-sectional view taken along line 7-7 of FIG. 1 and shows the operating device in the locked mode.
Figure 8:
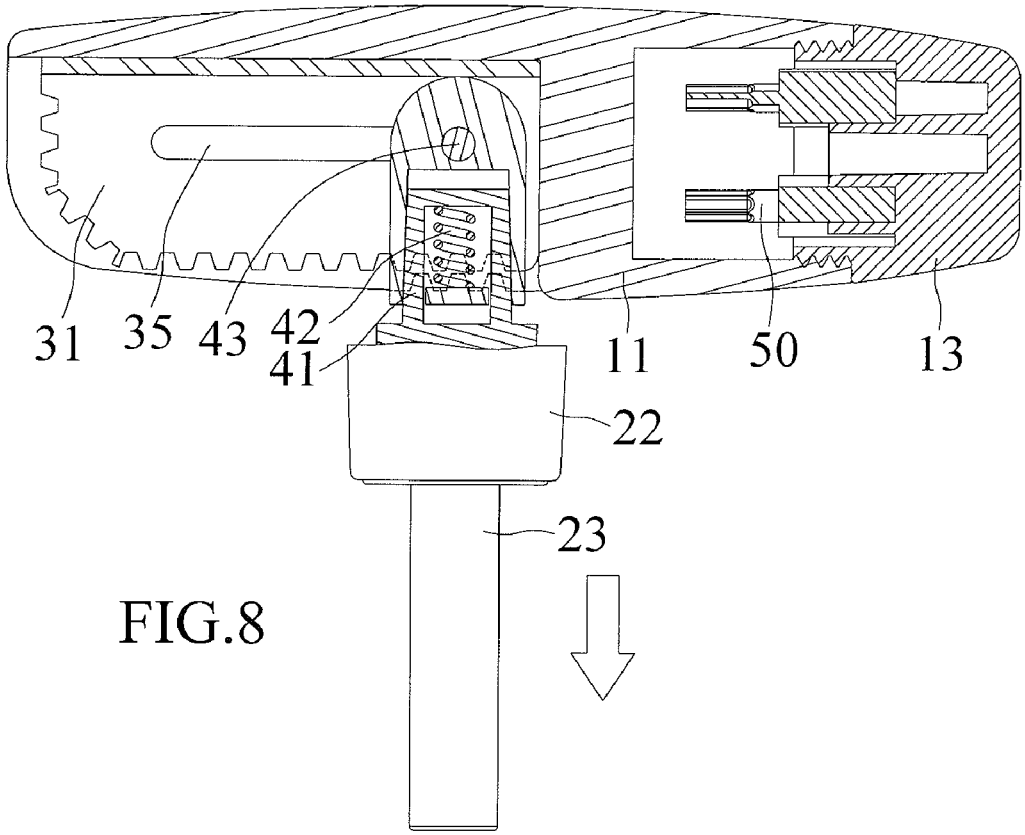
FIG. 8 is an extended cross-sectional view of FIG. 6 and shows the operating device in the released mode.
Figure 9:
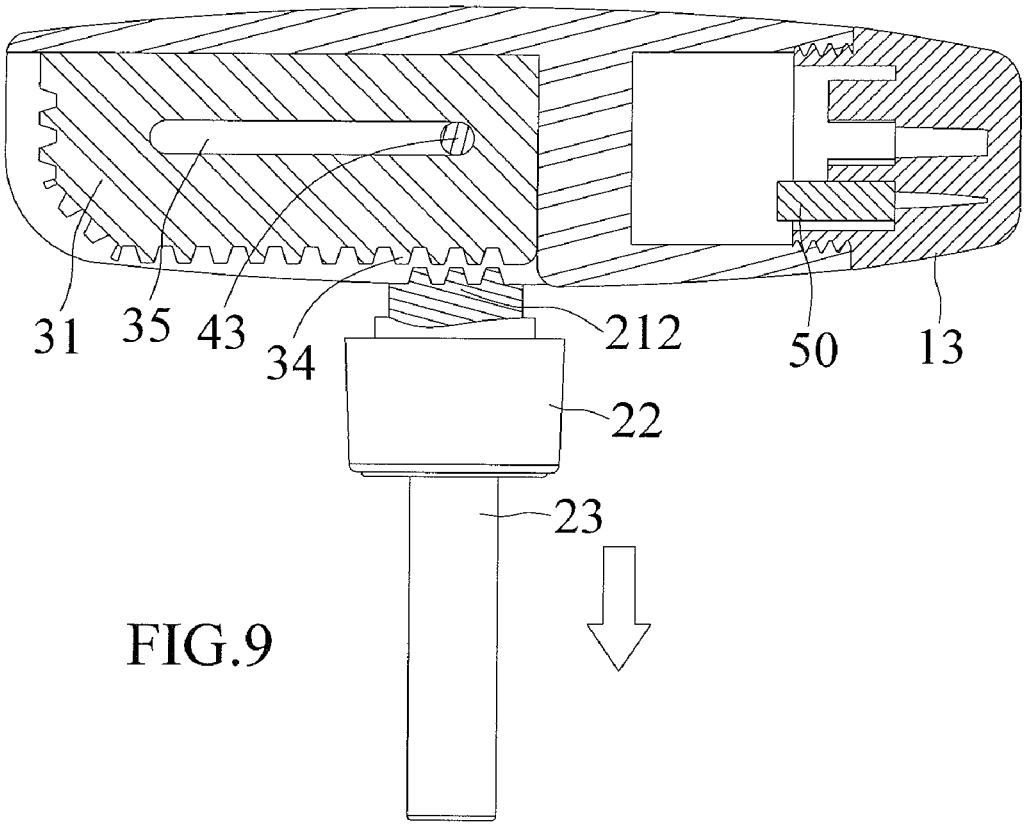
FIG. 9 is an extended cross-sectional view of FIG. 7 and shows the operating device in the released mode.
Figure 10:
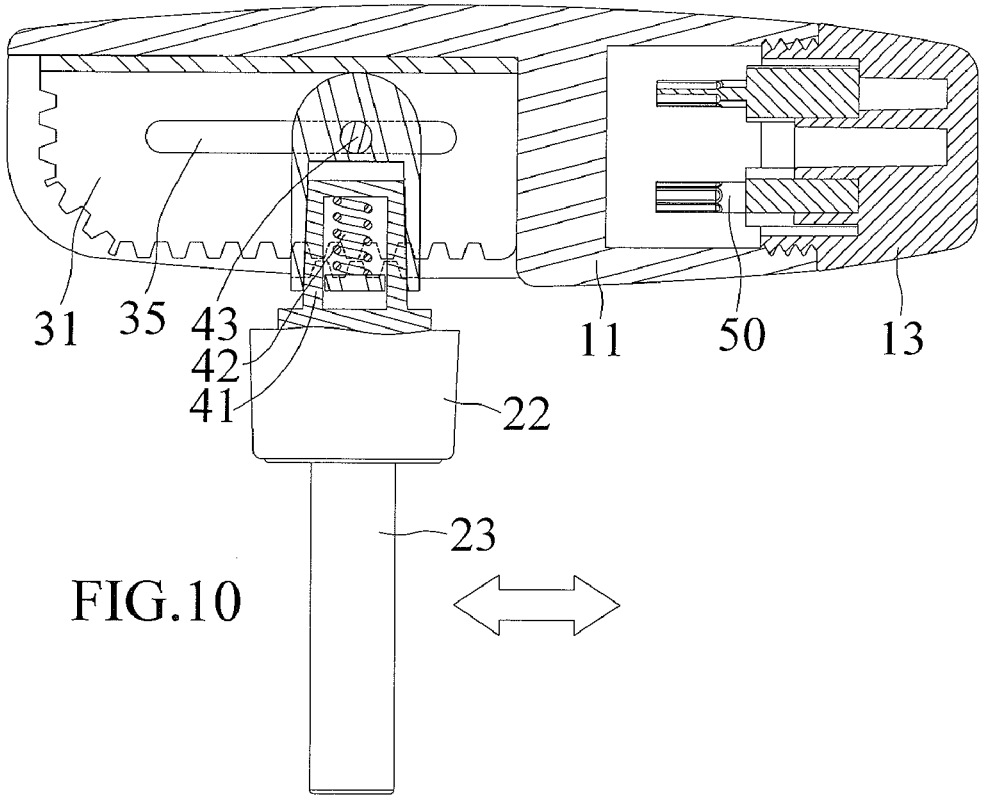
FIG. 10 is a continued cross-sectional view of FIG. 8 and illustrates that the operating device is adapted to be moved thereafter.
Figure 11:
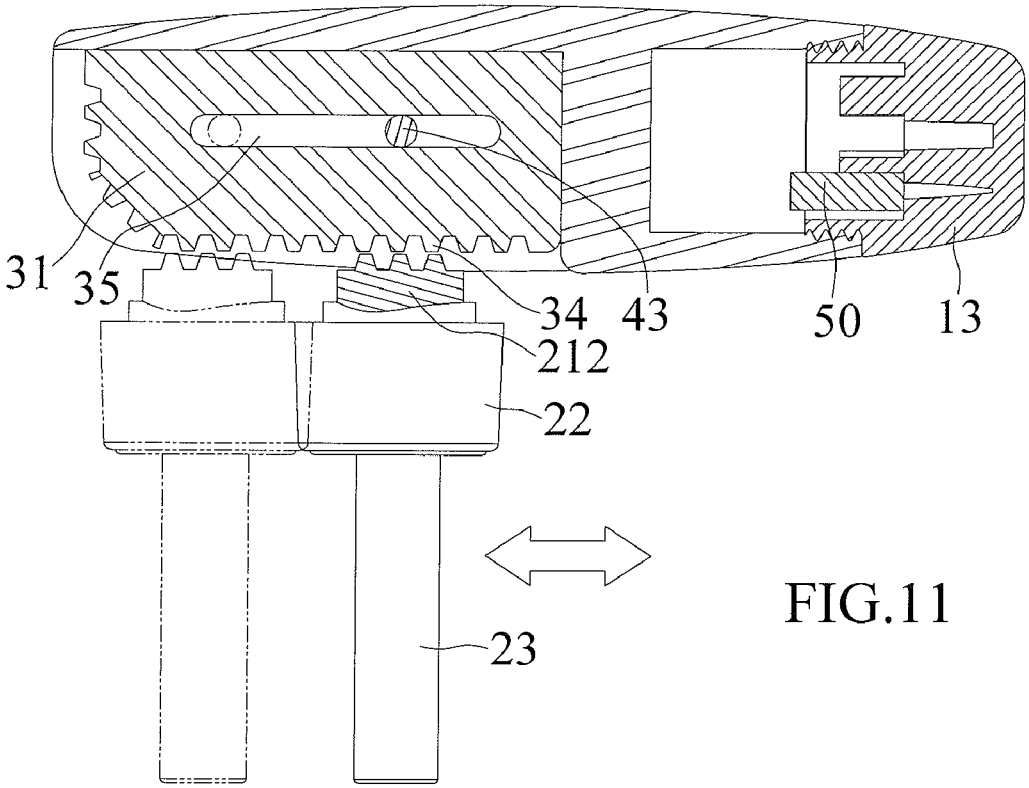
FIG. 11 is a continued cross-sectional view of FIG. 9 and illustrates that the operating device is adapted to be moved thereafter.
Figure 12:
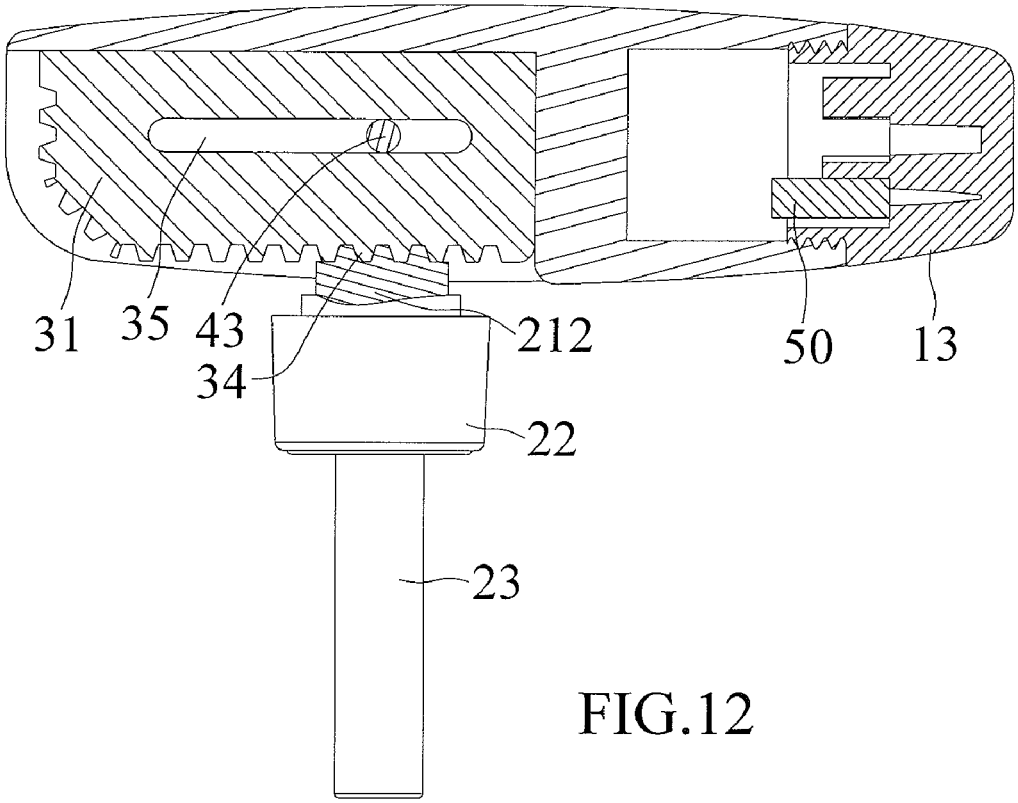
FIG. 12 is a continued cross section view of FIG. 11 and shows the operating device in the locked mode and in a different engaging position than in FIG. 7 such that the multi-angle hand tool is in a different operation mode than in FIG. 7.
Figure 13:
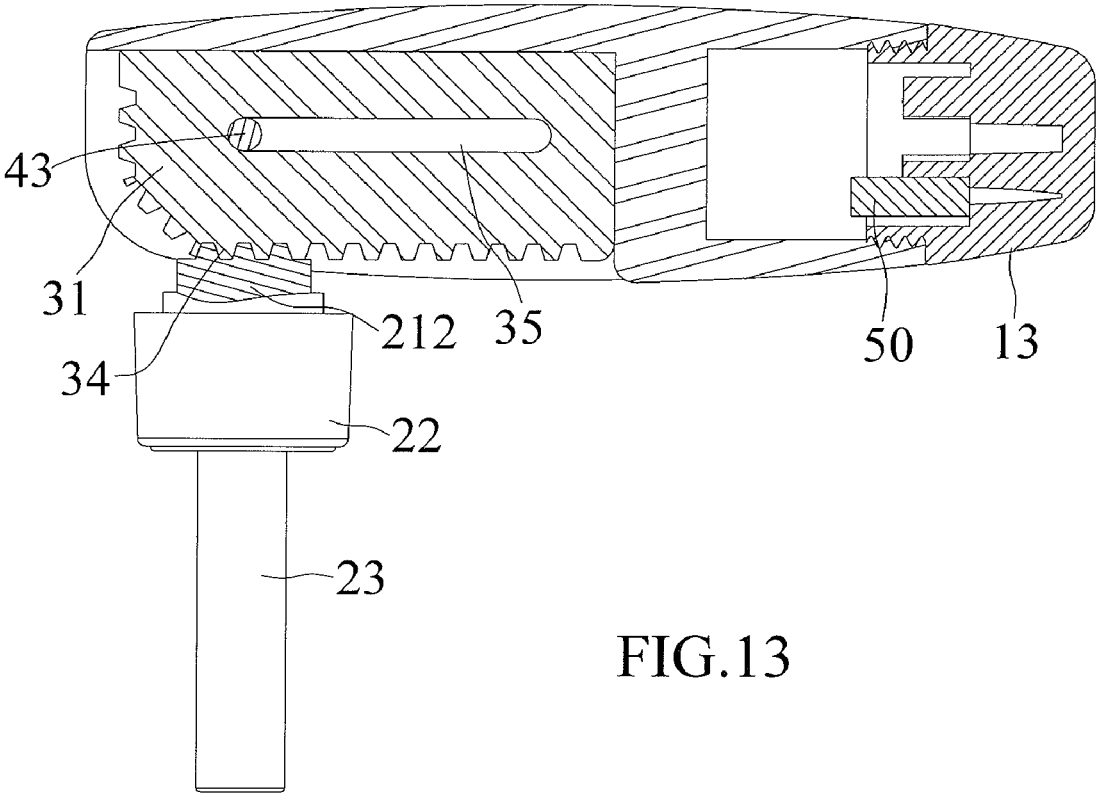
FIG. 13 shows that the multi-angle hand tool is in a different operation mode than in FIGS. 7 and 12.
Figure 14:
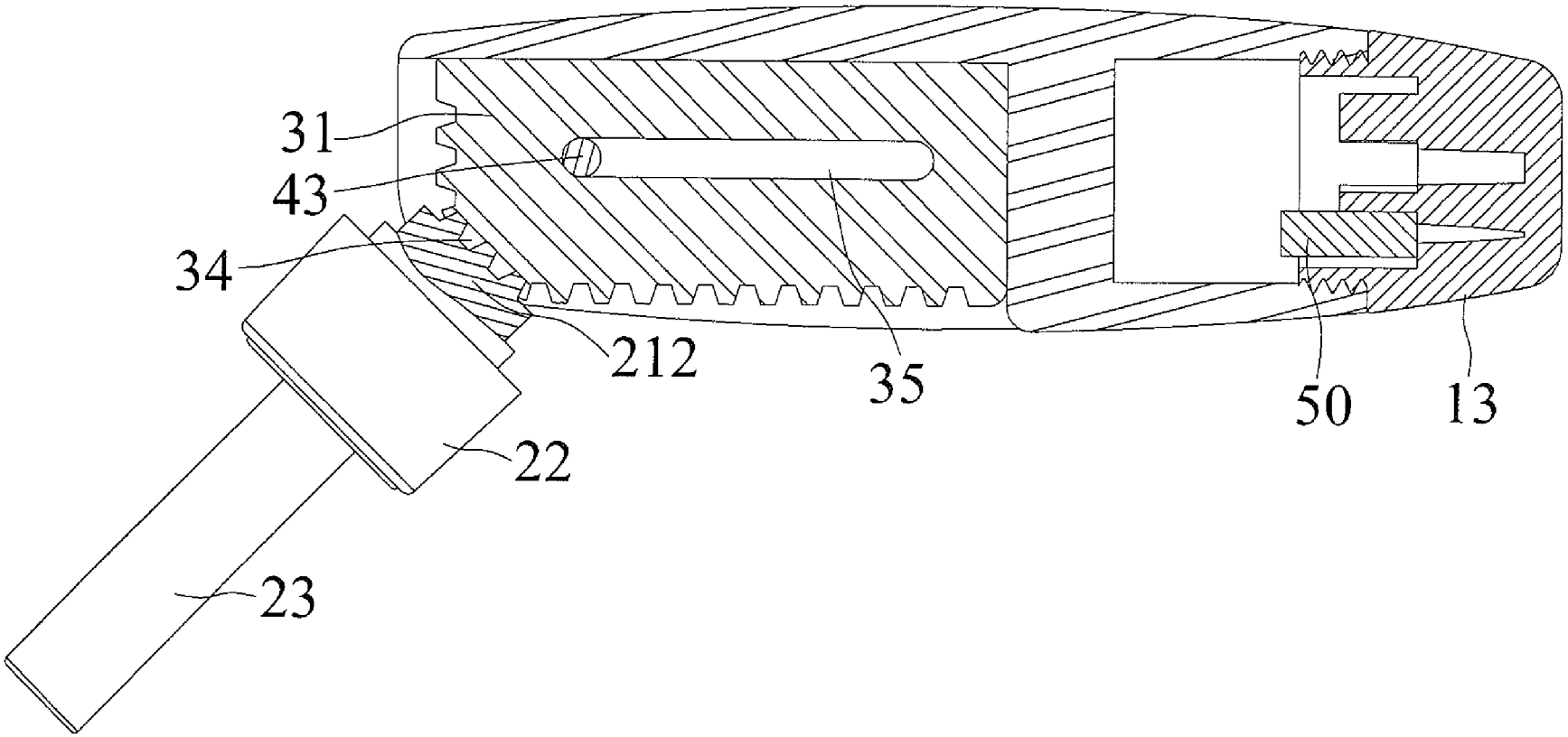
FIG. 14 shows that the multi-angle hand tool is in a different operation mode than in FIGS. 7, 12 and 13.
Figure 15:
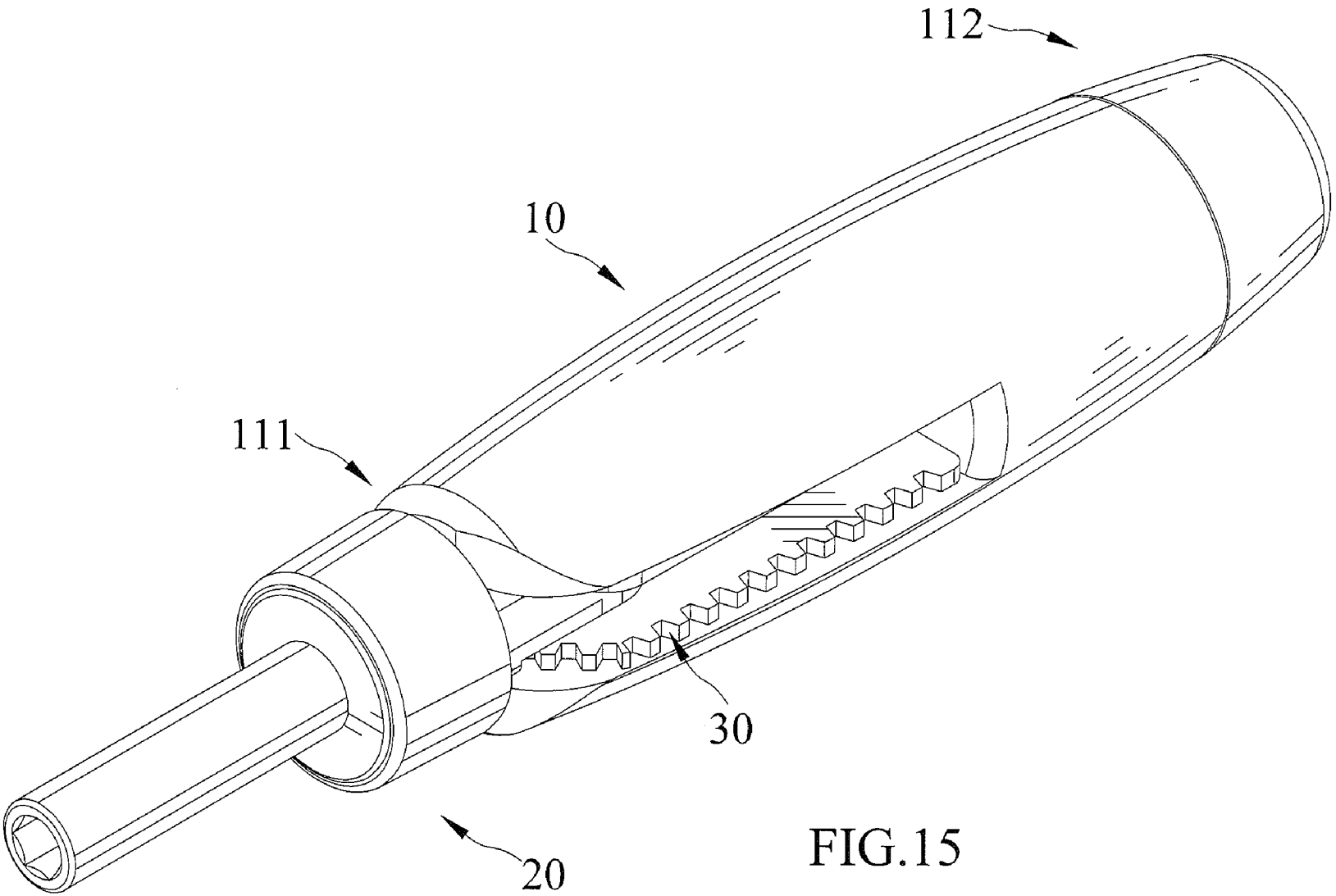
FIG. 15 is another perspective view of the multi-angle hand tool and shows that it is in a different operation mode than in FIGS. 7, 12, 13 and 14.
Figure 16:
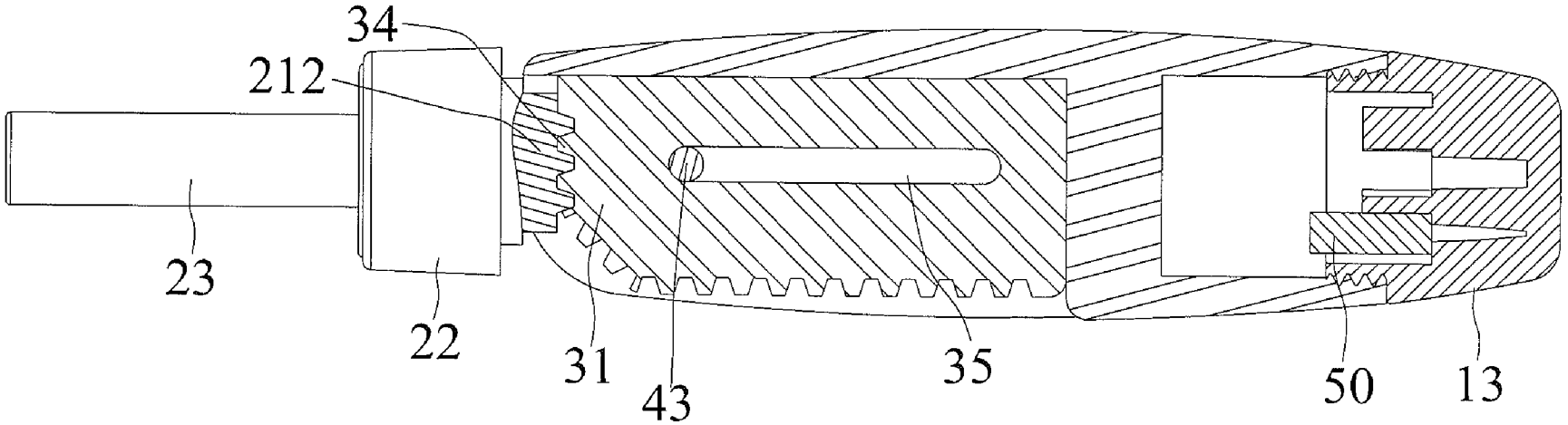
FIG. 16 is a cross-sectional view taken along line 16-16 of FIG. 15.

Referring to the drawings, a multi-angle hand tool in accordance with the present invention includes a shank 10, an operating device 20, a guide 30 and a connecting device 40.

The shank 10 includes a body 11 of an I shape and defines two opposing ends including a first end 111 and a second end 112. The shank 10 also includes a compartment 12 defined in an outer peripheral edge of the body 11 and exposed to outside. The compartment 12 extends from the first end 111 towards the second end 112 of the shank 10, but terminates before the second end 112. The body 11 and the compartment 12 have their longitudinal lengths extending in the same direction. Further, a cap 13 is adapted to receive a plurality of tool bits 50 and is releasably engaged on the second end 112 of the body 11. The cap 13 has an outer peripheral edge flush with that of the body 11.

The operating device 20 is connected to the guide 30 by the connecting device 40, and the guide 30 is inserted through an opening of the compartment 12 and mounted therein in a manner so that it is prevented from disengagement therefrom. Consequently, the operating device 20 and shank 10 are connected to each other. The operating device 20 includes a connecting end 21, a ratcheting mechanism 22 and a tube 23. The connecting end 21 includes a cavity 211 defined on a first side thereof and an engaging portion 212 defined on a second side thereof, which is opposite to the first side. The engaging portion 212 may be defined from a plurality of recesses or a plurality of teeth. Also, two adjacent recesses/teeth of the engaging portion 212 are aligned and may be spaced or non-spaced (not shown; i.e. no surface extending between roots of two adjacent recesses/teeth) from each other. Additionally, the ratcheting mechanism 22 is disposed at an end of the connecting end 21, and the tube 23 is disposed at an end of the ratcheting mechanism 22. Thus, the ratcheting mechanism 22 is disposed between the connecting end 21 and the tube 23. Furthermore, the tube 23 is rotatably connected to the ratcheting mechanism 22, and the ratcheting mechanism 22 is operable in three modes. Thus, the tube 23 can rotate clockwise in a first mode, can rotate counterclockwise in a second mode and is prevented from rotation in a third mode. In addition, one tool bit 50 is adapted to be received and held at an end of the tube 23.

The guide 30 includes a first wall 31, a second wall 32 and a third wall 33 engaged with three walls of the compartment 12 of the body 11 of the shank 10, respectively. The first and second walls 31 and 32 are spaced from each other and interconnected by the third wall 33 extending from a first edge of the first wall 31 to a first edge of the second wall 32. Additionally, the first and second walls 31 and 32 are planar and parallel to each other and the third wall 33 is planar and transverse to the first and second walls 31 and 32. Further, an embedding portion 34 is defined along a second edge of the first wall 31 and is engagable with the engaging portion 212 of the connecting end 21 of the operating device 20. The second edge has a first length corresponding to a section of the opening of the compartment 12 along the longitudinal length of the body 11 and a second length corresponding to another section of the opening of the compartment 12 along the first end 111 of the body 11, respectively. The embedding portion 34 may be defined from a plurality of recesses or a plurality of teeth. Also, two adjacent recesses/teeth are aligned and may be spaced or non-spaced (not shown; i.e. no surface extending between roots of two adjacent recesses/teeth) from each other. Accordingly, when the embedding portion 34 is engaged with the engaging portion 212, one recess/tooth or the embedding portion 34 is disposed between two adjacent recesses/teeth of the engaging portion 212. Further, a slot 35 extends axially and through the first and second walls 31 and 32. Also, the slot 35 extends parallel to an extent of the embedding portion 34 and corresponding to the longitudinal length of the body 11.

The connecting device 40 includes a block 41, a resilient member 42, and a shaft 43. The block 41 includes a recess 411 defined on a side thereof, a protrusion 412 extending from the side in a direction, and two opposing flanges 413 extending from the side in a direction the same as that of the protrusion 412. The resilient member 42 is disposed in the cavity 211 of the connecting end 21 of the operating device 20 and includes one of two opposing ends abutted against the protrusion 412 of the block 41 and the other of the two opposing ends abutted against a peripheral wall 2111 that delimits a portion of the cavity 211. The portion is between two opposing peripheral walls (not numbered) of the cavity 211. The two opposing peripheral walls are disposed corresponding to and engaging with the flanges 413 of the block 41, respectively. The shaft 43 is insertably mounted in the slot 35 and a bore 414 extending through the block 41. Thus, the block 41 is retained on the middle of the shaft 43, one of two distal ends of the shaft 43 is engaged with the first wall 31, and the other of the two distal ends of the shaft 43 is engaged with the second wall 32, respectively. Also, the shaft 43 is movable in the slot 35. Additionally, the block 41 is pivotal with respect to the guide 30 about the shaft 43.

Although not shown, the block 41 of the connecting device 40 and the connecting end 21 of the operating device 20 can be made integrally as one piece. In this case, the block 41 would include an opening to allow insertion of the resilient member 42 into the cavity 211.

The multi-angle hand tool has a plurality of operation modes, and, in each operation mode, the operating device 20 is prevented from moving and pivoting with respect to the shank 10. FIGS. 1, 12, 13, 14 and 15 illustrate the multi-angle hand tool in some specific operation modes in which the body 11 of the shank 10 and the operating device 20 are adapted to have their longitudinal lengths perpendicular to, angled non-perpendicularly to, or aligned with, each other selectively.

The operating device 20 has a locked mode such that the engaging portion 212 of the connecting end 21 is engaged with the embedding portion 34 of the guide 30. Accordingly, the operating device 20 is operated in the locked mode when the multi-angle hand tool is in one operation mode in order to prevent the operating device 20 from moving and pivoting with respect to the body 11 of the shank 10. Furthermore, the operating device 20 has a released mode, such that the engaging portion 212 of the connecting end 21 is disengaged from the embedding portion 34 of the guide 30. Consequently, the operating device 20 is able to be moved or pivoted for changing from one operation mode to another. Additionally, the resilient member 42 is under depression when the operating device 20 is operated in the released mode and is released from depression when the operating device 20 is operated in the locked mode, respectively. Once the resilient member 42 is released from depression, it springs back to an undepressed shape and provides a force to urge the engaging portion 212 of the connecting end 21 of the operating device 20 to automatically engage with the embedding portion 34 of the guide 30.

Figure 17:
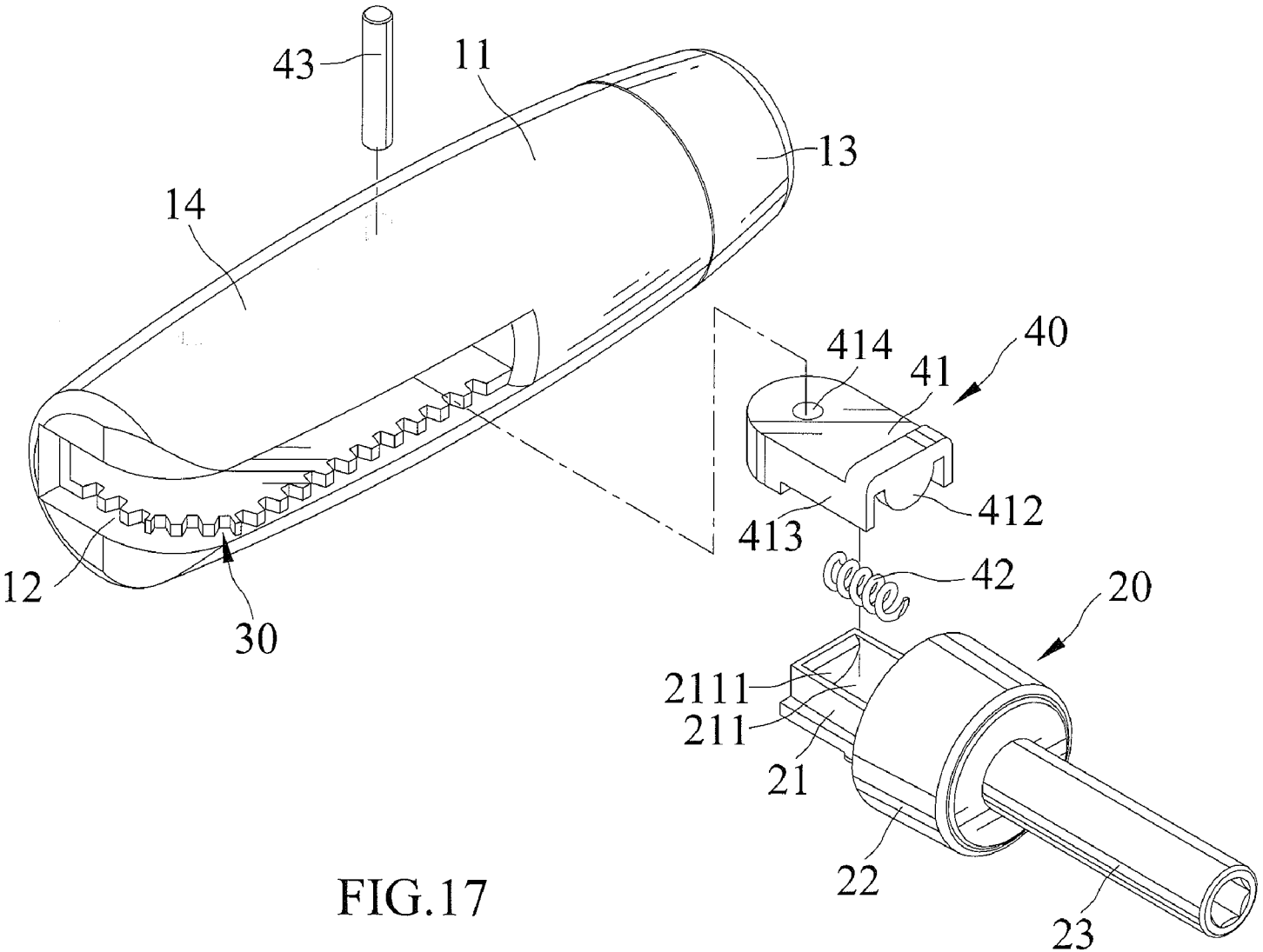
FIG. 17 is an exploded perspective view of the multi-angle hand tool in accordance with a second embodiment of the present invention.
Figure 18:
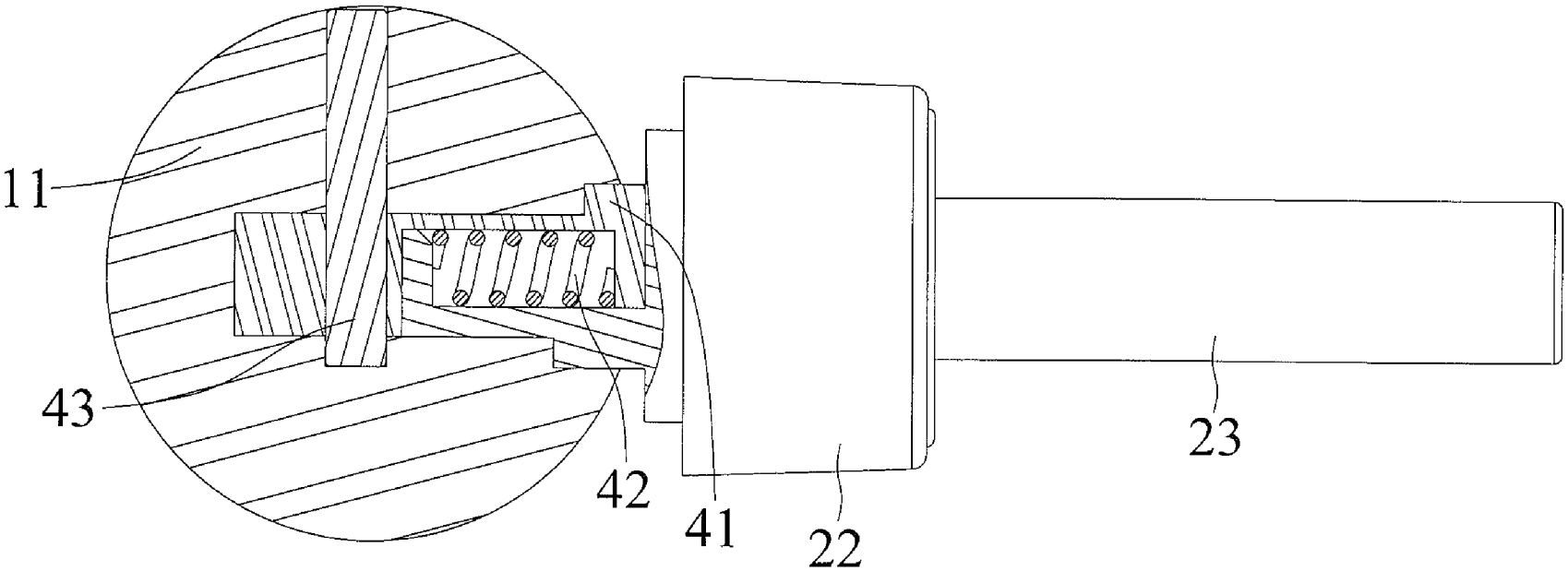
FIG. 18 is a cross-sectional view of the multi-angle hand tool shown in FIG. 17.

Moreover, FIGS. 17 and 18 show that the guide 30 is integrally formed with the body 11 of the shank 10, and the outer peripheral edge of the body 11 includes an orifice 14 extending therein and communicating with the slot 35 of the guide 30 as well as the bore 414 of the connecting device 40 for enabling the shaft 43 to achieve engagement in the slot 35 and the bore 414. This prevents the need for taking the guide 30 out of the compartment 12 for the purpose of connecting the operating device 20 to the guide 30.

In view of the forgoing, the multi-angle hand tool is an improved version of the multi-angle hand tool described in the Description of the Related Art in that it has more than three operation modes. Furthermore, the multi-angle hand tool has a simple structure.

While the specific embodiment have been illustrated and described, numerous modifications come to mind without significantly departing from the spirit of invention, and the scope of invention is only limited by the scope of the accompanying claims.

What is claimed is:

1. A multi-angle hand tool comprising:

a shank including a body, a compartment defined in an outer peripheral edge of the body, with the body and the compartment having longitudinal lengths extending in the same direction;

an operating device including a connecting end having an engaging portion defined thereon;

a guide mounted in the compartment and including an embedding portion defined thereon, with the embedding portion including a plurality of embedding ends sequentially disposed on a first wall of the guide, with the embedding portion engagable with the engaging portion; and a connecting device disposed and interconnected at an interconnection between the operating device and the guide to connect the operating device to the guide; and wherein the operating device is movable relative to the connecting device radially relative to the interconnection and is movable to positions engaging different embedding ends of the guide and pivotal with respect to the shank; and wherein the multi-angle hand tool has a plurality of operation modes and, in each operation mode, the operating device is prevented from moving and pivoting with respect to the shank by engaging the engaging portion with the embedding portion; and wherein a longitudinal length of the operating device is perpendicular to, angled non-perpendicularly to, or aligned with the longitudinal length of the body selectively for different operation modes.

2. The multi-angle hand tool as claimed in claim 1, wherein the guide further includes a second wall and a third wall engaged with three walls of the compartment, respectively, with the first and second walls spaced from each other and interconnected by the third wall extending from a first edge of the first wall to a first edge of the second wall.

3. The multi-angle hand tool as claimed in claims 2, wherein the connecting device includes a resilient member selectively depressed responsive to a radial movement of the operating device relative to the connecting device between a locked mode and a released mode thereof, with the engaging portion of the operating device engaged with the embedding portion of the guide when in the locked mode, with the engaging portion of the operating device disengaged from the embedding portion of the guide when in the released mode, and with the resilient member rendering a force to urge the engaging portion have the radial movement towards the embedded portion to automatically engage with the embedding portion when changing from the released mode to the locked mode thereof.

4. The multi-angle hand tool as claimed in claim 3, wherein the connecting device includes a block connecting the operating device and the guide, with the block pivotal about a shaft defining the interconnection, and with the shaft moveable relative to the guide.

5. The multi-angle hand tool as claimed in claim 4, wherein the guide includes a slot defined therein and extending parallel to an extent of the embedding portion and corresponding to the longitudinal length of the body, and with the slot receiving the shaft.

6. The multi-angle hand tool as claimed in claims 1, wherein the connecting device includes a resilient member selectively depressed responsive to a radial movement of the operating device relative to the connecting device between a locked mode and a released mode thereof, with the engaging portion of the operating device engaged with the embedding portion of the guide when in the locked mode, with the engaging portion of the operating device disengaged from the embedding portion of the guide when in the released mode, and with the resilient member rendering a force to urge the engaging portion have the radial movement towards the embedded portion to automatically engage with the embedding portion when changing from the released mode to the locked mode thereof.

7. The multi-angle hand tool as claimed in claim 6, wherein the connecting device includes a block connecting the operating device and the guide, with the block pivotal about a shaft defining the interconnection, and with the shaft moveable relative to the guide.

8. The multi-angle hand tool as claimed in claim 7, wherein the guide includes a slot defined therein and extending parallel to an extent of the embedding portion and corresponding to the longitudinal length of the body, and with the slot receiving the shaft.

9. The multi-angle hand tool as claimed in claim 1, wherein the shank includes a cap releasably engaged with the body, with the cap adapted to receive a plurality of tool bits, and with the cap having an outer peripheral edge flush with the outer peripheral edge of the body.

10. The multi-angle hand tool as claimed in claim 1, wherein the operating device includes a tube having an end adapted to engage with and hold a tool bit therein.

11. The multi-angle hand tool as claimed in claim 10, wherein the operating device includes a ratcheting mechanism operable in three modes, wherein the tube rotates clockwise in a first mode, rotates counterclockwise in a second mode and is prevented from rotation in a third mode.

12. The multi-angle hand tool as claimed in claim 1, wherein the operating device includes a ratcheting mechanism operable in three modes, wherein the tube rotates clockwise in a first mode, rotates counterclockwise in a second mode and is prevented from rotation in a third mode.

13. The multi-angle hand tool as claimed in claim 1, wherein the embedding portion is defined from a plurality of recesses or teeth.

14. A multi-angle hand tool comprising:

a shank including a body, a compartment defined in an outer peripheral edge of the body, with the body and the compartment having longitudinal lengths extending in the same direction;

an operating device including a connecting end having an engaging portion defined thereon;

a guide mounted in the compartment and including an embedding portion defined thereon, with the embedding portion engagable with the engaging portion; and a connecting device disposed and interconnected between the operating device and the guide to connect the operating device to the guide;

wherein the operating device is movable and pivotal with respect to the shank;

wherein the multi-angle hand tool has a plurality of operation modes and in each operation mode, the operating device is prevented from moving and pivoting with respect to the shank by engaging the engaging portion with the embedding portion;

wherein a longitudinal length of the operating device is perpendicular to, angled non-perpendicularly to, or aligned with the longitudinal length of the body selectively for different operation modes;

wherein the connecting device includes a resilient member selectively depressed responsive to a movement of the operating device between a locked mode and a released mode thereof, with the engaging portion of the operating device engaged with the embedding portion of the guide when in the locked mode, with the engaging portion of the operating device disengaged from the embedding portion of the guide when in the released mode, and with the resilient member adapted to render a force to urge the engaging portion to automatically engage with the embedding portion when changing from the released mode to the locked mode thereof;

wherein the connecting device includes a block connecting the operating device and the guide, with the block pivotal about a shaft, and with the shaft moveable relative to the guide; and wherein the connecting end of the operating device includes a cavity defined on a first side thereof and a second side opposite to the first side, with the engaging portion defined on the second side, and with the resilient member disposed in the cavity and including one of two ends abutted against the block and the other of the two ends abutted against a peripheral wall that delimits a portion of the cavity.

15. A multi-angle hand tool comprising:

a shank including a body, a compartment defined in an outer peripheral edge of the body, with the body and the compartment having longitudinal lengths extending in the same direction;

an operating device including a connecting end having an engaging portion defined thereon;

a guide mounted in the compartment and including an embedding portion defined thereon, with the embedding portion engagable with the engaging portion; and a connecting device disposed and interconnected between the operating device and the guide to connect the operating device to the guide;

wherein the operating device is movable and pivotal with respect to the shank;

wherein the multi-angle hand tool has a plurality of operation modes and, in each operation mode, the operating device is prevented from moving and pivoting with respect to the shank by engaging the engaging portion with the embedding portion;

wherein a longitudinal length of the operating device is perpendicular to, angled non-perpendicularly to, or aligned with the longitudinal length of the body selectively for different operation modes;

wherein the guide includes a first wall, a second wall and a third wall engaged with three walls of the compartment, respectively, with the first and second walls spaced from each other and interconnected by the third wall extending from a first edge of the first wall to a first edge of the second wall;

wherein the connecting device includes a resilient member selectively depressed responsive to a movement of the operating device between a locked mode and a released mode thereof, with the engaging portion of the operating device engaged with the embedding portion of the guide when in the locked mode, with the engaging portion of the operating device disengaged from the embedding portion of the guide when in the released mode, and with the resilient member adapted to render a force to urge the engaging portion to automatically engage with the embedding portion when changing from the released mode to the locked mode thereof;

wherein the connecting device includes a block connecting the operating device and the guide, with the block pivotal about a shaft, and with the shaft moveable relative to the guide; and wherein the connecting end of the operating device includes a cavity defined on a first side thereof and a second side opposite to the first side, with the engaging portion defined on the second side, and with the resilient member disposed in the cavity and including one of two ends abutted against the block and another of the two ends abutted against a peripheral wall that delimits a portion of the cavity.

* * * * *